United States Patent [19]

Gaubert

[11] Patent Number: 4,568,321

[45] Date of Patent: Feb. 4, 1986

[54] APPARATUS AND METHOD FOR MAKING BAGS FROM FLEXIBLE FILM MATERIAL

[76] Inventor: Rene J. Gaubert, 4219 Oakmore Rd., Oakland, Calif. 94602

[21] Appl. No.: 643,199

[22] Filed: Aug. 22, 1984

[51] Int. Cl.[4] ..... B31B 1/84

[52] U.S. Cl. ..... 493/213; 493/929

[58] Field of Search ..... 493/102, 122, 129, 212, 493/213, 214, 215, 927, 929, 932, 195, 206; 156/252, 308.2; 406/83, 86

[56] References Cited

U.S. PATENT DOCUMENTS

| | | | |
|---|---|---|---|
| 2,981,443 | 4/1961 | Baldwin | 222/183 |
| 3,069,303 | 12/1962 | Scholle | 493/213 |
| 3,160,443 | 12/1964 | Harris et al. | 406/86 |
| 3,223,117 | 12/1965 | Curie et al. | 222/522 |
| 3,642,172 | 2/1972 | Malpas | 222/554 |
| 3,868,891 | 3/1975 | Parish | 493/213 |
| 3,930,286 | 1/1976 | McGowen | 222/83 |
| 3,977,161 | 8/1976 | Faber et al. | 193/40 |
| 4,341,522 | 7/1982 | Gaubert | 493/213 |

FOREIGN PATENT DOCUMENTS

| | | | |
|---|---|---|---|
| 335920 | 3/1959 | Switzerland | 193/40 |

*Primary Examiner*—Francis S. Husar
*Assistant Examiner*—Robert Showalter
*Attorney, Agent, or Firm*—Flehr, Hohbach, Test, Albritton & Herbert

[57] ABSTRACT

A machine and method for making bags from two webs of film material with the bag being provided with a fitting having an access passageway therethrough and a flange that is heat sealed to the inner side of one wall of the bag. The two webs are advanced step by step from a feed station, the movement during each step being for lengths of the webs sufficient to provide portions for making a bag. The movement of the web is through successive stations with one web underlying an upper web. In the first of the successive station fittings are fed into a trackway having a downwardly sloped portion and a horizontal portion extending below the upper web. A hole is punched in the upper web and at the end of the horizontal position of the trackway is provided which serves to receive and align the fitting with a hole in the upper web, during a pause in the advancing movement of the webs. The elevator serves to elevate the fitting to a position within the aligned hole and then the flange of the fitting is heat sealed to the underside of the upper web while the fitting is elevated. Thereafter the upper and lower webs are progressed with the attached fitting to a bag forming station where the web portions are superposed and the margins heat sealed to form a bag.

9 Claims, 14 Drawing Figures

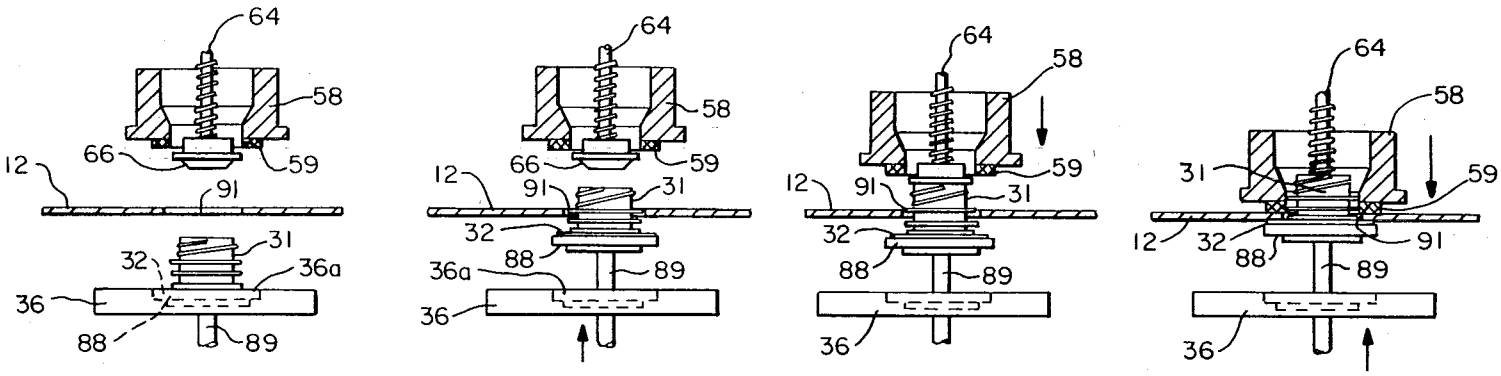
FIG.—7A
FIG.—7B
FIG.—7C
FIG.—7D
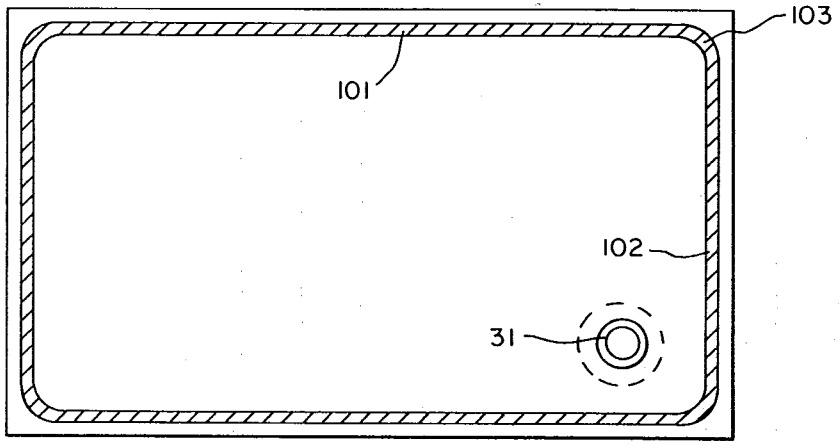
FIG.—9
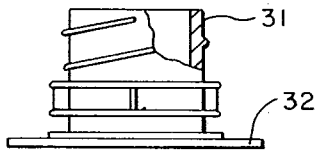
FIG.—8

APPARATUS AND METHOD FOR MAKING BAGS FROM FLEXIBLE FILM MATERIAL

This invention relates generally to the making of bags from flexible film material, such as plastic, laminated plastic, metalized plastic, and laminated plastic and metal foil. The invention is particularly applicable to the making of bags in various sizes, including relatively large bags such as are suitable for containing liquid or semi-liquid food or other bulk products.

Bags made of flexible film material are widely used in the food, wine and other industries. Many of such bags are provided with a fitting which provides an access passageway, and which is employed for filling, and/or dispensing operations. Smaller bags or pouches of this type are frequently used as a part of a package, the fitting in that instance being used for attaching a dispensing tap. Such packaging is disclosed in Curie et al. U.S. Pat. No. 3,223,117, Baldwin U.S. Pat. No. 2,981,443, Malpas U.S. Pat. No. 3,642,172 and McGowen U.S. Pat. No. 3,930,286, and Gaubert U.S. Pat. No. 4,341,522. The fittings are annular with a flange at one end which can be secured to one wall of the bag as by heat bonding. In some instances the passageway provided by the fitting is sealed as by means of a frangible diaphragm, which is disrupted when it is desired to dispense the contents. In other instances the fitting is sealed by means of a closure cap which is applied after the bag has been filled. The fitting is generally bonded to one wall of the bag in such a manner that the flange and the body of the fitting are external of the bag interior.

Aside from pouches or bags having one or more of such fittings, which become a part of a package that is sold in the consumer trade, larger sized bags are employed for containing various liquid and semi-liquid materials, as for example, pureed tomato or tomato concentrate, fruit juices, and fruit juice concentrates. For such uses the bag must have considerable strength, both with respect to the fabrication of the bag from webs of flexible film material, and with respect to the attachment of one or more fittings to one wall of the bag.

In general it is an object of the present invention to provide a bag making machine and method which functions automatically to produce bags made of flexible film material in the larger sizes, and provided with one or more access fittings.

Another object of the invention is to provide a machine and method for the manufacture of such bags, which attaches a fitting in such a manner that the flange is on the inside of the bag, rather than on the outside surface of one of the bag walls.

Another object is to provide a novel flat bag having an access fitting, and which is constituted in such a manner as to provide seal areas at the corners of the bag which resist leakage.

Another object is to provide a novel machine and method which functions automatically to provide completed bags which have an access fitting on a side wall of the same, with the flange of the fitting heat bonded to the inner surface of one of the side walls.

In general a machine incorporating the present invention employs means carried by the machine frame for advancing upper and lower webs of film material from a first feed station in a general horizontal direction and lengthwise of the frame. The advancing movement of both films is step by step, with periods of rest between the steps. The movement during each step is such that it provides equal lengths of film material for making a bag. Means is provided at a second station for punching a hole in the upper web during a period of rest. Means is provided at a third station for presenting flanged fittings to a position beneath the upper web. This position is such that during a period of pause the fitting is aligned with the axis of a hole in the web. Means is provided at the third station for supporting and elevating the deposited fitting. Another assembly overlies the web and is in alignment with the support and elevating means. Means is provided which serves to elevate the fitting support means to carry the fitting to a position in which the body of the fitting extends into the hole of the web. A pressor assembly overlies the fitting support means and serves to press a heated area of the supporting means against the underside of the flange and to press the flange against the underside of the upper web, thereby heat bonding the flange to the web. At a fourth station means is provided for forming bags from equal lengths of the film material by a heat sealing operation which serves to seal side, end and corner margins of the superposed lengths of material, whereby each bag is formed with a fitting in one wall of the same with the flange of the fitting on the inside of the bag. Preferably the machine also employs means for holding the fitting against misalignment with a hole in the upper web above the same. The means for presenting fittings one by one to a region below the upper web in the fitting securing region preferably includes a trackway which has an inclined portion and a horizontal portion extending to a position below the upper web, the fittings being propelled along the horizontal portion by air jets directed upon the same. The marginal sealing of the web portions to form the bag preferably are continuous sealed areas that provide rounded corners.

Additional objects and features of the invention will appear from the following description in which the preferred embodiment is set forth in detail in connection with the accompanying drawing.

Referring to the drawing

FIGS. 7A, 7B, 7C and 7D are schematics serving to illustrate the manner in which fittings are elevated and caused to be projected into an aligned hole in the upper web, and then heat bonded to the web.

FIG. 8 illustrates a typical fitting for attachment to a wall of the bag.

FIG. 9 is a plan view of a completed bag.

FIG. 11 is a schematic diagram showing circuitry for controlled operation of the draw rolls.

Figure 1:
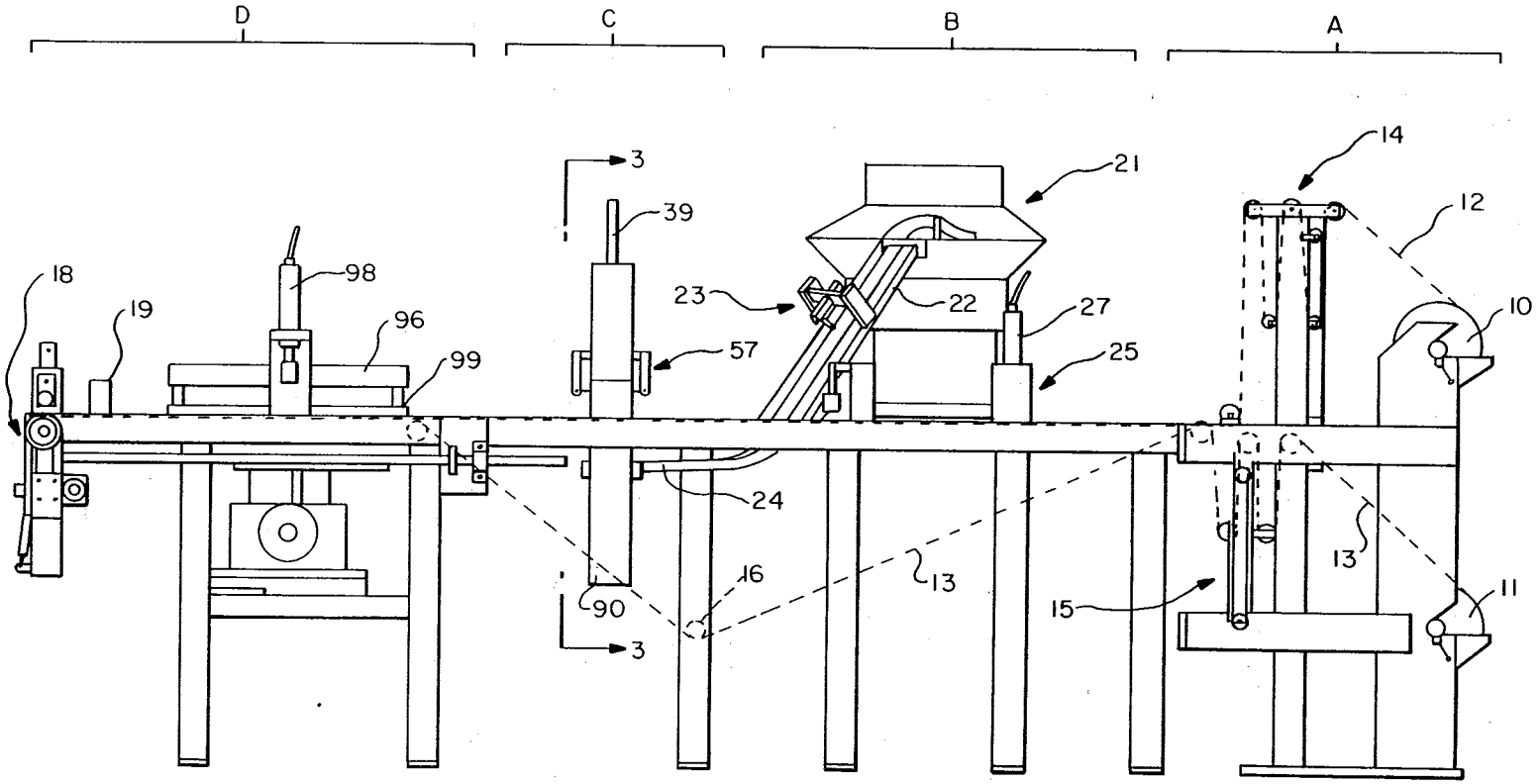
FIG. 1 is a side elevational view of a machine incorporating the present invention.

Previous reference has been made to my U.S. Pat. No. 4,341,522 issued July 27, 1982 for Method and Apparatus for Making Pouches With Dispensing Fittings. The machine in that instance is particularly designed for the production of the smaller sized bags or pouches, such as are used in the bulk packaging of wine for the consumer trade. In common with the machine of my U.S. Pat. No. 4,341,522, the present machine progresses upper and lower webs of flexible film material step by step, from a first feed station to a final bag making and bag severing operation. The various operating stations of the present invention indicated in FIG. 1 include the first feed station A, from which the two webs are supplied, a second station B where fittings to be attached are supplied one by one and holes are punched in the upper web, a third station C where the fittings are introduced into the web holes and are heat bonded to the upper web, and a fourth station D where the two webs are brought into superposed relationship and heat sealed to form a bag, and where the webs are engaged by draw rolls which serve to advance both webs step by step, and also where the successive bags are severed from each other.

The web feeding means at station A is of the type shown and described in U.S. Pat. No. 4,341,522. Briefly it includes rolls 10 and 11 of the film material, with the webs 12 and 13 extending from these rolls passing through the feed equalizing assemblies 14 and 15. Each of these assemblies makes use of a plurality of loops of the web, the loops providing sufficient lengths of the web whereby during the advancing movements of the webs the loops are shortened to provide the web material required. During periods of rest the loops are extended to provide material for the next advancing movement. The lower web 13 is looped under the roll 16, and from thence passes directly to the bag forming station D. This serves to separate the two webs while they progress through the stations B and C. This station includes the draw rolls 18 which are driven intermittently to obtain the desired intermittent progression of the webs through the machine. Also station D is shown including a sensing device 19, which may be in the form of an electric eye, which senses spaced markings on the webs and serves to control the energization of the motor which drives the draw rolls 18. Station D also includes the cutting knives 20, which are power operated to severe the bags. The unit 21 in station B serves to orient fittings and to supply them single file to the discharge chute or trackway 22. A trigger mechanism 23 associated with the inclined section of the trackway 22, may be generally the same as the trigger mechanism 93 disclosed in FIG. 4 of U.S. Pat. No. 4,341,522. It may be actuated either pneumatically and/or electrically. The trackway 22 also has a generally horizontal portion 24, which extends beneath the position occupied by the upper web.

As the upper web progresses from the feed station A toward the fitting supplying unit 21, during each period of pause a hole is punched at regular intervals along the length of the web, by the hole punching means 25. This punching means can be one of a known type having a punch actuated by means such as a pneumatic operator 27.

Figure 4:
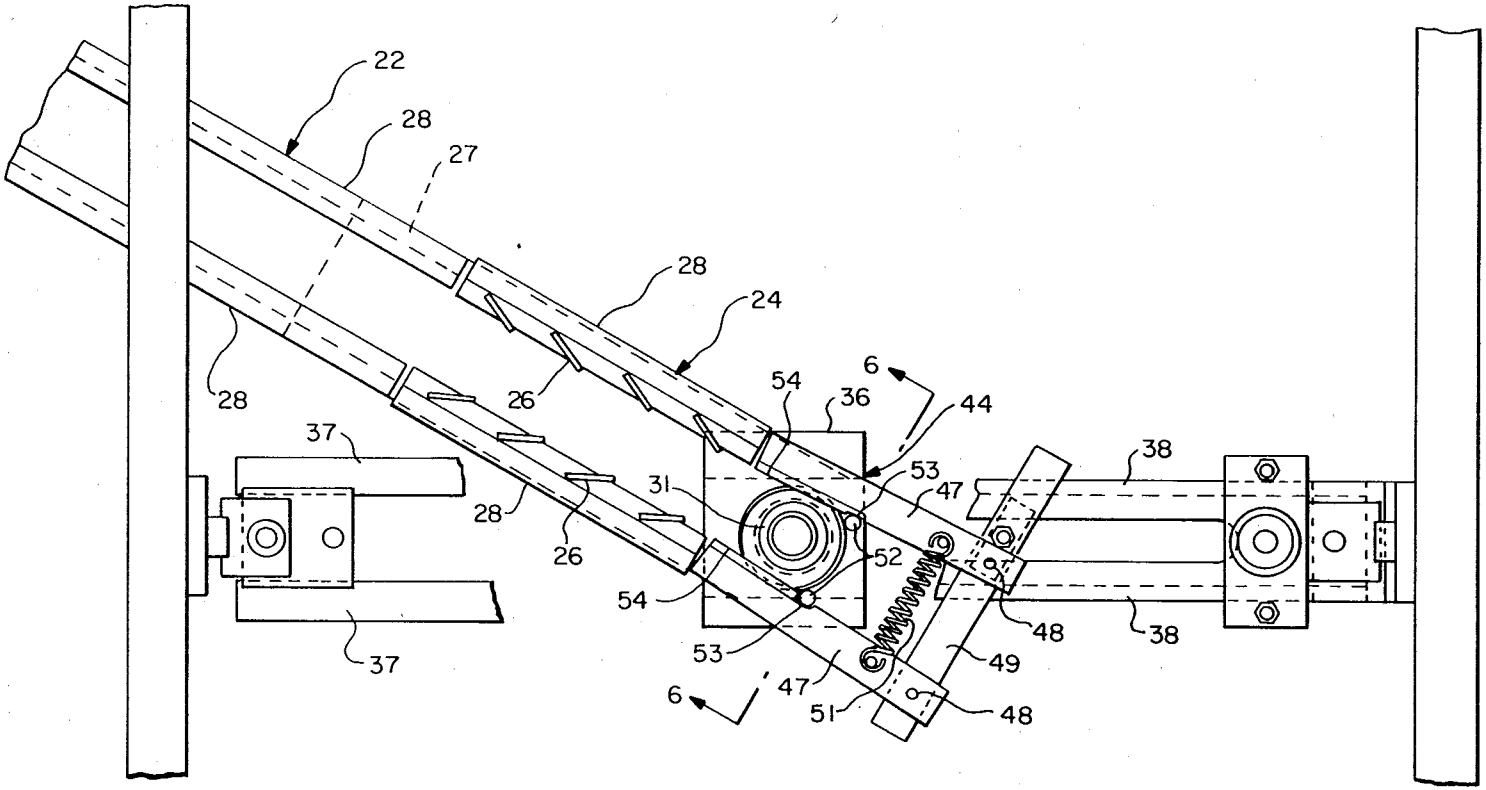
FIG. 4 is a view taken along the line 4—4 of FIG. 3, showing the horizontal portion of the trackway and associated means for presenting fittings to a position from which they are elevated and attached to the upper web by heat sealing.

When a fitting in the inclined portion of the trackway 22 is released, it progresses downwardly by gravity to the horizontal portion 24. As shown in FIG. 4 the sides of the horizontal portion 24 of the trackway are provided with pneumatic nozzles 26, and air under pressure supplied to these nozzles serves to create propelling jets of air which apply thrust to a fitting to propel it to the end of the trackway. The air supplied to these jetting nozzles may be continuous, or may be intermittent in accordance with operation of the release trigger 23. The trackway is constructed to slidably retain the fittings in single file, with the flanges of the fittings loosely retained within grooves or channels 27 formed in the side members 28.

Although the specific construction of the fittings may vary depending upon requirements, a typical type, made of suitable molded plastic material, is illustrated in FIG. 8. The body extension 31 is annular in section and may be substantially cylindrical. The annular flange 32 is integrally formed with the body 31, and is made of material that can be heat bonded to the surface of the film material forming the bag. As previously mentioned, the trackway is so constructed that opposite side portions of the flange 32 are loosely accommodated in the grooves or channels 27, of the side bars 28, and thus slide freely under the urge of the air jets. The horizontal section 24 of the trackway delivers the fittings to the position illustrated in FIG. 4. Underlying the discharge end of the horizontal section 24 there is a stationary plate 36 which is mounted upon the cross bar 37. Another cross bar 38 (FIG. 3) located above and extending parallel to bar 37, has its extremities slidably secured to the frame of the machine. Thus slide rods 39 are carried by the vertically spaced slide bearings 41 and 42, and the extremities of the bar 38 are secured to the rods 39. Pneumatic operators 43 are mounted upon the bar 37, and have their operating members secured to the extremities of the bar 38. By pneumatic actuation of the operators 43, the bar 38 is cyclically raised and lowered.

Figure 6:
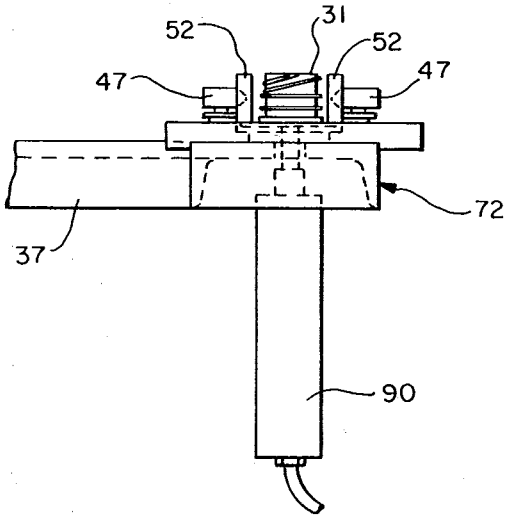
FIG. 6 is a cross-sectional detail taken along the line 6—6 of FIG. 4.

Aligning and retaining means 44 at the discharge end of the horizontal section 24 of the delivery track serves to locate and retain the fitting in a predetermined position in alignment with a hole that has been punched in the upper web, and also in alignment with pressor means to be presently described. Means 44 overlies the plate 36 and consists of fingers 47 having pivotal connections 48 with a member 49 that is clamped on the bar 38. A light tension spring 51 serves to urge the free ends of the fingers 47 toward each other. The free end portions of the fingers have apposed faces that are beveled or chamfered as shown at 54 in FIG. 6. The beveling or chamfering of the lower sides of the fingers should provide recesses for accommodating the flange of a fitting. Also the fingers engage the stationary pins 52 which are mounted on plate 36. The pins engage the fingers 47 within the notches 53, and form abutments adapted to be engaged by the flange of a fitting and to limit movement of the fingers under the urge of spring 51. When a fitting is delivered to the aligning means 44, it comes to rest with its flange accommodated within recess **36*a* formed in the plate 36, with its flange in contact with the pins 52**. Thereafter the fingers may spread apart a sufficient distance to permit the fitting to be raised during the course of projecting it into a hole in the upper web.

Figure 3:
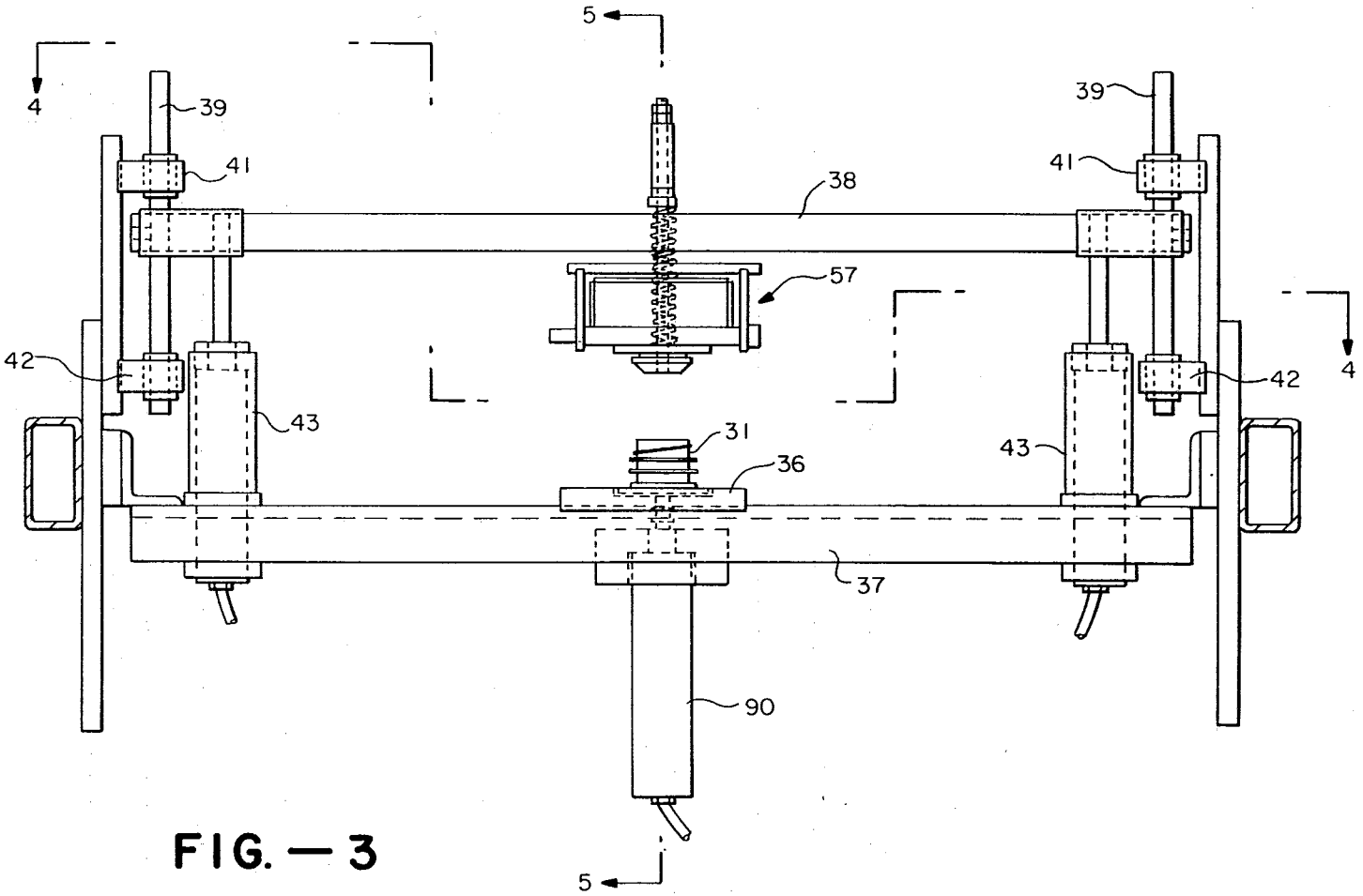
FIG. 3 is a cross-sectional view taken along the line 3—3 of FIG. 1.
Figure 5:
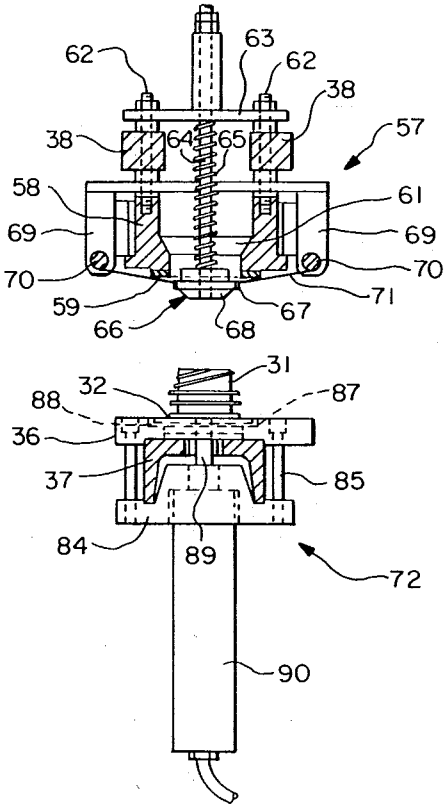
FIG. 5 is a detail partly in section, illustrating means for elevating the fittings together with an assembly for carrying out a heat sealing operation.

FIG. 3 illustrates a pressor assembly 57 carried by bar 38, which cooperates in carrying out a heat bonding operation. The construction of this assembly is shown in FIG. 5. It consists of an annular body 58 which is attacted by suitable means such as stud bolts 62, to the bar 38. The lower annular face of the body may have an annular heat bonding or sealing element 59. The interior 61 of the body 58 is annular in section and dimensioned to adequately accommodate the body extension 31 of a fitting. Stud bolts 62 serve to secure the assembly to the bar 38. A bar 63 serves to slidably retain a rod 64 that is urged downwardly by the compression spring 65. A head 66 is attached to the lower end of rod 64, and is made with a circular portion 67, and a portion 68 which conforms to a truncated cone. The circular portion 67 has a diameter substantially equal to the external diameter of the fitting body, and the base of the conical portion 68 is substantially equal to or somewhat less than the inner diameter of the fitting body. In its lower limiting position, FIGS. 7A and 7B, the head 66 is slightly below the heating element 59, and is generally aligned with the body 31 of a fitting carried below the same. The assembly 57 also preferably includes the depending members 69 which carry the horizontal rolls 70, disposed on opposite sides of the body 58. These rolls are spring urged and serve to support and tension a membrane 71, which is apertured and which has the margins of the aperture underlying the heating element 59. The membrane can be made of flexible material which conducts heat from the heating element to the underlying portion of the upper web, without being deteriorated by the temperatures involved. It has a hole of a diameter less than that of the fitting flange but large enough to accommodate the body of the fitting.

FIG. 5 also shows the assembly 72 below the assembly 57, for elevating the fitting preliminary to a heat bonding operation. This assembly includes the previously mentioned stationary plate 36. The bar 37 is shown in this view as structural steel channel, having the plate 36 and a lower plate 84 clamped upon the same, as by means of bolts 85. The plate 36 has an annular recess 87 that is dimensioned to accommodate the elevating member or disk 88. The elevating member has a diameter substantially equal to the diameter of the flange 32 of the fitting. The trackway and assembly 44 have been omitted from FIG. 5. The elevating member 88 is attached to the upper end of the operating rod 89 of the pneumatic operator 90. Thus when the pneumatic operator is actuated by air under pressure, it raises the elevating member 88 and a fitting upon the same, whereby the body of the fitting is caused to pass upwardly into the hole in the web. Thereafter assemblies 57 and 72 cooperate to carry out bonding of the fitting flange to the web. The plate 36 has an annular recess **36*a* to accommodate the elevating member 88 and when member 88 is in its lowered position, the upper portion of the recess is dimensioned to accommodate the flange 32** of the fitting.

Cooperation between the assemblies 57 and 72 is illustrated in FIGS. 7A–7D. FIG. 7A schematically illustrates the two assemblies, with the assembly 57 in its uppermost position, and the elevating member 88 in its lowermost position. The upper web 12 is shown between the fitting and assembly 57, with the hole 91 in the web aligned with the axis of the fitting and the flange 32 accommodated within the recess **36*a*. In carrying out a bonding cycle, the operator 90 is energized to commence elevation of the fitting as shown in FIG. 7B, whereby the fitting is advanced into the hole 91. At or about the same time the assembly 57 commences downward movement toward the fitting. FIG. 7C illustrates the head 66 engaging the top of the fitting body, thereby insuring proper aligned retention of the fitting. With continued lowering of the assembly 57, the head 66 remains seated upon the fitting and continues to press against the fitting during further lowering of assembly 57. Eventually the flange and the margin of the web surrounding the hole are tightly pressed together (FIG. 7D) for a heat bonding operation. After a short interval during which heat bonding is completed, the cycle is terminated by de-activating the operators 90 and 43 whereby the elevating member 88 is returned to its original position, and the heat assembly 57** is raised to its initial position.

In the foregoing description, the heat surface for heat bonding is on the lower face of the body. Instead of, or in addition to such an arrangement, the heat sealing surface may be on the upper face of mamber 88.

Figure 2:
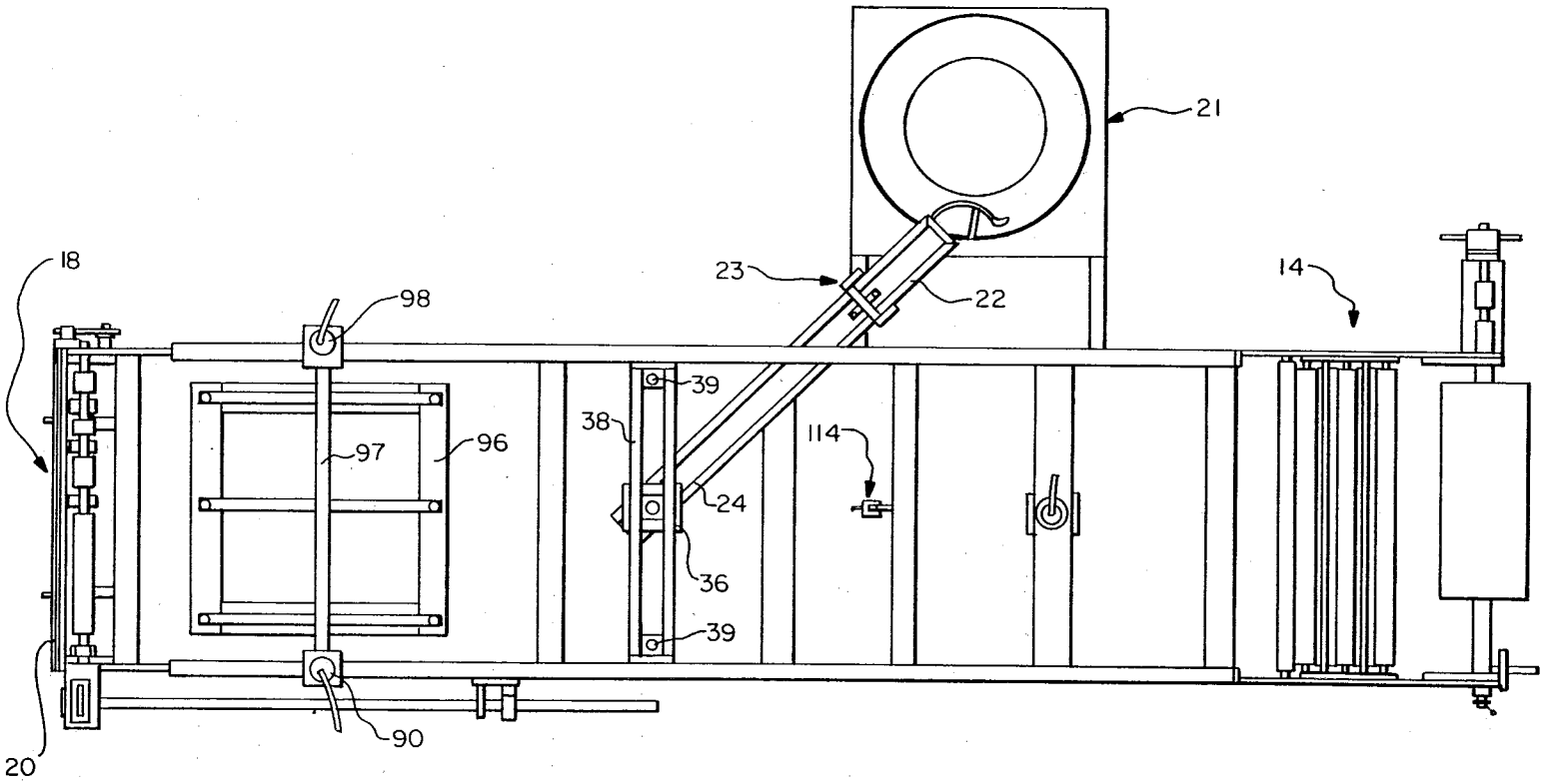
FIG. 2 is a plan view of the machine, with certain parts removed.

After the fitting has been bonded to the upper web in the manner previously described, the two webs are brought together in superposed relationship as they enter the station D. The construction and operation of this station is similar to that disclosed in my U.S. Pat. No. 4,341,522. However in this instance a frame 96 (FIG. 2) forms the pressing head, and is carried by the crossbar 97. This bar in turn has its extremities secured to the operating members of the pneumatic operators 98. The lower face of the frame 96 has a continuous electrically heated area corresponding to the dimensions of the bag margin which is to be heat sealed. Underlying the pressor frame 96 there is a plate 99 serving as a fixed support for the web during the heat bonding operation.

Preferably the sealed area along the margins and corners of the bag have a configuration as shown in FIG. 9. The side and end sealed areas 101 and 102 are joined by the arcuate corner areas 103. All of the sealed areas are formed without overlapping. In other words, the complete sealed areas are continuous without discontinuity or overlapping. This is contrary to conventional bag making practice, where the side and end areas come to a right angle corner, and one side or end sealing area may have its ends overlapping connecting areas. The use of arcuate corner areas has a distinct advantage. Particularly it provides a stronger construction that resists leakage at the corners, when the bag is filled with a liquid or semi-liquid material.

From the bag making operation the connected bags pass through the draw rolls 18, which are driven intermittently, in accordance with desired step by step movement of the webs. In conjunction with the draw rolls, there is also a cutting assembly 104 to severe the bags.

Figure 10:
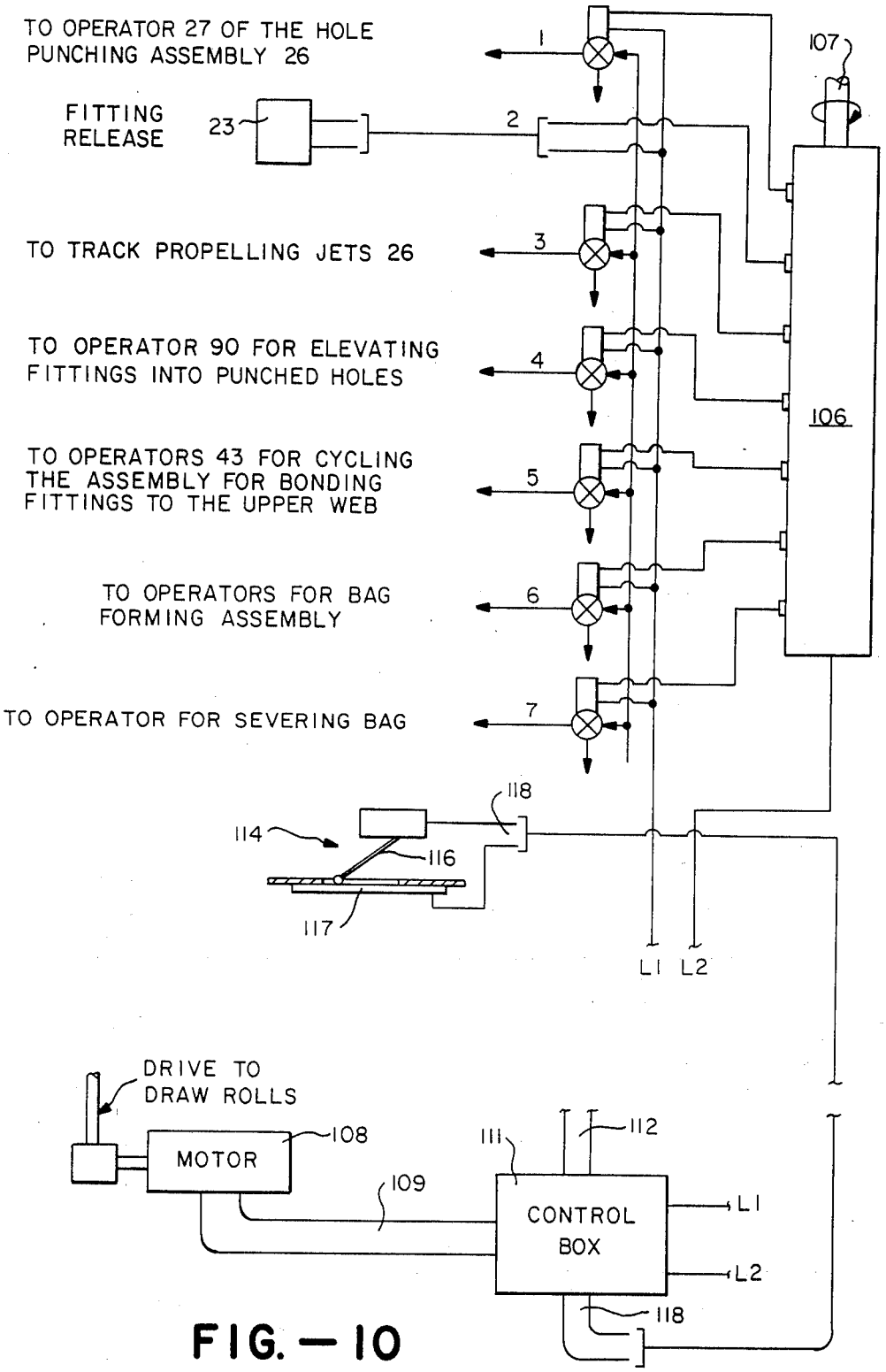
FIG. 10 is a schematic diagram of a system for carrying out the various functions in a programmed manner.

The various operations of the machine and of the method involved, are programmed to carry out the various operations as the webs are advanced through the machine. Reference has been made to the use of pneumatic operators which are activated by air under pressure as controlled by programming means. In the present instance the pneumatic operators are assumed to be of the cylindrical/piston type that are spring biased whereby after being actuated they return to initial position when the cylinder is vented to the atmosphere. Another type of cylinder/piston operator which can be used requires a four-way pilot valve, whereby in one position of the pilot valve under pressure is supplied to one end of the cylinder to obtain actuation of the same, with the other end of the cylinder being vented to the atmosphere. The operator is actuated to its original condition by venting said one end of the cylinder to the atmosphere, and applying pneumatic pressure to the other end. FIG. 10 illustrates a pneumatic system for actuating the various pneumatic operators to carry out the desired operations in accordance with a predetermined program. The programming means 106 in this instance may consist of a plurality of programming cams carried by a common rotatable shaft 107, with each cam adapted to effect operation of an electrical switch. Circuits controlled by the switchs in turn are indicated as effecting operation of solenoid valves, which control the supply and exhaust of pneumatic air under pressure from the various pneumatic operators. As shown in the drawing the solenoid operated valve 1 controls supply of air under pressure to the hole punching assembly, thus causing this assembly to be actuated to punch a hole in the upper web 12 during a period of pause. Subsequently the fitting release assembly 23 is actuated electrically by circuit 2 responsive to closing one of the switches of the programming means. If desired, the release trigger may be actuated pneumatically, in which event the corresponding circuit of the programming means 106 will serve to operate a solenoid valve, which in turn controls the supply of air and exhaust of air from the pneumatic operator which operates the fitting release. Solenoid valve 3 serves to supply air under pressure to the trackway propelling jets 26, immediately after release of a fitting. Solenoid control valve 4 supplies under pressure to the operator 90 which elevates the fitting into a punched hole in the upper web 12. Solenoid valve 5 serves to actuate the operators 43 which cycle the assembly for bonding fittings to the upper web. Solenoid valve 6 supplies air under pressure to the pneumatic operators 98 for the bag forming assembly. The operators 98 are activated to raise the frame 96 to permit passage of the fitting, immediately before and after a heat sealing operation. Solenoid valve 7 supplies air under pressure to an operator for severing bags at the end of the machine.

Shaft 107 and the functions described above are synchronized with advancing movements of the webs, whereby the essential operations upon the upper web, namely punching of the hole, the supplying of fittings, the heat bonding of fittings to the upper web, the formation of bags by heat sealing operations and then the severing of the bags, are carried out in a controlled manner, likewise in synchronism with the step by step advancing movement of the web.

As previously mentioned, the step by step movement of the webs is obtained by step by step driving of the draw rolls 18. In the schematic FIG. 10 the draw rolls are assumed to be driven by the motor 108, which preferably is of the type which operates at a constant speed when electrically actuated, and has quick starting and quick stopping characteristics. The circuit 109 for energizing the motor 108, connects with the control box 111. The control box is connected to the power supply lines L1 and L2, and is controlled by the electrical circuit 112, which in turn is controlled by suitable means such as an electric eye. Thus the electric eye, by detecting markings located at spaced intervals along the upper web, controls the starting and stopping of the motor 106 to obtain the desired advancing movement of the webs, with timed intervening periods of pause. Such an arrangement, for step by step advancing movement of plastic webs, is well known.

FIG. 10 shows means 114 that can be used in place of an electric eye. It consists of a mounting for a downwardly urged spring pressed conductive member 116. As the web 12 proceeds from the punching station, it passes over a conductive plate 117 below member 116. When the webs have been advanced a proper amount, the end of member 116 enters the hole to contact plate 117. This contact controls circuit 118 which connects with control box 111. When a hole is sensed, motor 108 is de-energized for a predetermined period of pause as determined by the timing means. Thereafter the motor is again energized.

It will be evident from the foregoing that I have provided a machine capable of operating at a relatively high speed, and which effectively produces bags in the larger sizes which are provided with access fittings having flanges on the inner side of the bag. The machine and method are preferably operated in such a manner as to produce a bag such as is shown in FIG. 9.

What is claimed is:

1. A method for the manufacture of bags from webs of flexible film material, with the bag being provided with a fitting having an access passageway therethrough, the fitting having an annular body portion and a flange on one end of the body, the steps of progressing upper and lower webs of film material in a generally horizontal direction, the advancing movement being step by step with periods of pause between advancing steps, the movement of the web during each step being for lengths of the webs sufficient to provide portions for making a bag, the upper web being caused to progress through hole punching, fitting securing and bag forming stations, punching a hole in the upper web in the hole punching station during a rest period, advancing and presenting fittings one by one to a region below the upper web in the fitting securing station with the fitting being supported with the body of the fitting extending upwardly from the flange, elevating the fitting to cause the body of the fitting to be projected to a position within an aligned hole in the upper web, retaining the fitting during the latter part of the elevating movement by yieldably pressing downwardly on the upper end of the fitting body, then at said securing station subsequently heat sealing the flange to the under side of the upper web while the fitting is elevated, progressing the corresponding upper and lower web portions to the bag forming station after the heat sealing operation, with the upper and lower web portions superposed and with the fitting secured to the upper web portion, and heat sealing peripheral margins of the portions together to form a bag having the fitting in one wall of the bag.

2. A method as in claim 1 in which the advancing of the fittings one by one to a region below the upper web in the fitting securing station is carried out by releasing a fitting in an elevated portion of a trackway, whereby the fitting progresses by gravity to a level below the level of the upper web and then causing the fitting to be propelled along a generally horizontal trackway below the upper web, to a position in alignment with a hole in the upper web.

3. A method as in claim 2, propelling the fitting in the horizontal track portion by air jets.

4. A machine for the manufacture of bags from webs of flexible materials, with the bag being provided with a fitting secured to one wall of the same, the fitting having an access passageway therethrough and a flange on one end of the fitting, a supporting machine frame, means carried by the frame for advancing upper and lower webs of the film material in a general horizontal direction lengthwise of the frame, the advancing movement of both films being step by step with periods of pause between the steps, the movement during each step being for equal lengths of film material for making a bag, means carried by said frame for punching a hole in the upper web during each period of rest, means located downstream from said punching means for presenting flanged fittings one by one to a position beneath the upper web and at a location in alignment with a previously formed hole in the upper web, said location also being such that during each period of pause the fitting is aligned with the axis of a hole, vertically moveable support means located at said location for supporting a fitting in said location, actuating means connected below said vertically movable support means for elevating the support means to transpose a fitting thereon into an aligned hole in the upper web, a vertical moveable presser assembly carried by the frame above and in alignment with the support means, said presser assembly including a presser member, means connected to said frame for lowering the presser assembly whereby the flange of a fitting is urged in face to face contact with the lower surface of the web in a marginal region of the web surrounding the hole, said assembly also including a spring urged head for engaging and pressing downward on the upper end of the fitting body during and after elevation of the fitting, heating means on the lower face of the presser member for carrying out a heat sealing operation between the web and the flange while the flange is so urged against the web, and means carried by the machine frame serving to form bags from said equal lengths of film material, said last means including means for heat sealing side and end margins of said superposed lengths of the upper and lower webs, whereby each bag is thereby formed with a fitting in one wall of the same with the flange of the fitting on the inside of the bag.

5. A machine as in claim 4 in which the means for presenting the individual fittings to a region below the upper web and in alignment with a hole punched in the web consists of a trackway having an inclined portion and a horizontal portion extending to a position below the upper web, means located on said inclined trackway portion for releasing fittings one by one from a position on the inclined trackway portion, whereby the fitting travels down the inclined portion of the trackway to the generally horizontal portion, said means located on said horizontal trackway portion for directing jets of air into the horizontal trackway portion to propel fittings therethrough to the alignment position.

6. A machine as in claim 5 in which means is provided at the end of the horizontal portion of the trackway for receiving and releasably retaining the fitting upon the support means in said alignment position, said means including spring urged fingers engaging side portions of the fitting flange when the fitting progresses into said alignment position.

7. A machine as in claim 6 in which the said spring urged fingers form a guideway for the flange of the fitting, and stationary abutment means is provided at the end of said horizontal portion of the trackway for arresting movement of a fitting in a position of alignment with the hole and presser assembly.

8. A machine as in claim 7 in which the fingers may spread apart when the support means is elevated to elevate the fitting.

9. A machine as in claim 5 in which a horizontal stationary plate is carried by the frame and disposed at the end of the horizontal portion of the trackway whereby fittings are deposited thereon, said plate having a recess for accomodating said vertically moveable support means when the fitting thereon is aligned with said axis of a hole in the upper web.

* * * * *